US006959551B2

(12) United States Patent
Baudoin et al.

(10) Patent No.: US 6,959,551 B2
(45) Date of Patent: Nov. 1, 2005

(54) AEROMECHANICAL INJECTION SYSTEM WITH A PRIMARY ANTI-RETURN SWIRLER

(75) Inventors: Christophe Baudoin, Bri Comte Robert (FR); Patrice-André Commaret, Rubelles (FR); Christophe Viguier, Alfortville (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 10/194,230

(22) Filed: Jul. 15, 2002

(65) Prior Publication Data

US 2003/0010034 A1 Jan. 16, 2003

(30) Foreign Application Priority Data

Jul. 16, 2001 (FR) ..... 01 09456

(51) Int. Cl.[7] ..... F02C 3/00; F23R 3/14; F23R 3/30

(52) U.S. Cl. ..... 60/748; 239/404

(58) Field of Search ..... 239/399–406; 431/9, 182, 183, 184; 60/800, 737, 748, 743

(56) References Cited

U.S. PATENT DOCUMENTS 3,703,259 A * 11/1972 Sturgess et al. ..... 60/748
3,946,552 A * 3/1976 Weinstein et al. ..... 60/748
5,117,637 A * 6/1992 Howell et al. ..... 60/748
5,319,935 A * 6/1994 Toon et al. ..... 60/748
5,417,070 A * 5/1995 Richardson ..... 60/748
5,966,937 A 10/1999 Graves
6,035,645 A * 3/2000 Bensaadi et al. ..... 60/748
6,314,739 B1 * 11/2001 Howell et al. ..... 60/748
6,427,435 B1 * 8/2002 Patterson et al. ..... 60/800
6,571,559 B1 * 6/2003 Fortuna et al. ..... 60/748
6,735,950 B1 * 5/2004 Howell et al. ..... 60/748

FOREIGN PATENT DOCUMENTS

EP 0 469 899 2/1992
FR 2 246 734 5/1975

* cited by examiner

*Primary Examiner*—Ted Kim
(74) *Attorney, Agent, or Firm*—Oblon, Spivak, McClelland, Maier & Neustadt, P.C.

(57) ABSTRACT

An injection system for a turbomachine combustion chamber, the system comprising a fuel injection nozzle for vaporizing fuel in the combustion chamber and a mixer/deflector assembly coaxial with the injection nozzle and serving to mix fuel and oxidizer and to diffuse the mixture in the combustion chamber, said mixer/deflector assembly comprising a primary swirler and a secondary swirler disposed at a determined distance apart from each other in the axial direction and separated by a Venturi device disposed coaxially with the injection nozzle, the primary swirler being fixed securely to the injection nozzle and being spaced apart therefrom by a constant radial distance which is determined in such a manner that the fuel vaporized by the injection nozzle can under no circumstances impact on the primary swirler. The Venturi device preferably has an inside surface that presents an upstream portion with a slope discontinuity P.

4 Claims, 2 Drawing Sheets

PRIOR ART

AEROMECHANICAL INJECTION SYSTEM WITH A PRIMARY ANTI-RETURN SWIRLER

FIELD OF THE INVENTION

The present invention relates to the specific field of turbomachines, and more particularly it relates to the problem posed by injecting fuel into the combustion chamber of a turbomachine.

PRIOR ART

Conventionally, in a turbojet or a turboprop, and as shown in FIG. 4, fuel is injected into a combustion chamber 50 via a plurality of injection systems 52 each comprising firstly a fuel injection nozzle 54 for vaporizing the fuel in the combustion chamber, and secondly a mixer/deflector assembly 56 which serves to mix the fuel and the oxidizer and to diffuse the mixture inside the combustion chamber. The mixer/deflector assembly comprises a first spinner device or primary swirler 58 slidably mounted on the fuel injection nozzle 54 (via a sleeve 60), a Venturi device 62, a second spinner device or secondary swirler 64, and a deflector 66 fixed on the end wall of the combustion chamber 68. French patent application No. 2 728 330 and U.S. Pat. No. 5,490,378 are both good examples of the prior art. It should be observed that in all injection systems that have been disclosed in the past, and as shown in FIG. 5, the inside surface 62A of the Venturi against which the fuel vaporized by the injection nozzle 54 impacts always presents a continuous surface (without any slope discontinuity) all the way to the air outlet from the primary swirler.

Nevertheless, under certain particular conditions of use, that conventional architecture for the injection system presents the major drawback of presenting a risk of self-ignition of a kind that can cause the combustion chamber to be destroyed. The impact of fuel on the inside surface of the Venturi, which is needed in order to obtain a film of fuel whose fragmentation into fine droplets is guaranteed by the shear generated by the primary and secondary swirlers, sometimes leads to fuel rising into the vanes of the primary swirler. In addition, because the zone in which the fuel impacts on said inside surface is not accurately localized, it is possible that fuel can be injected in the reverse direction in said primary swirler. Unfortunately, such reverse flow of fuel in the primary swirler can contribute to bringing the fuel to the outside of the flame tube and thus runs the risk of destroying the combustion center of the combustion chamber of the turbomachine.

OBJECT AND DEFINITION OF THE INVENTION

The present invention mitigates those drawbacks by proposing an injection system for a turbomachine combustion chamber, the system comprising firstly a fuel injection nozzle for vaporizing fuel in the combustion chamber and secondly a mixer/deflector assembly disposed coaxially with said injection nozzle and serving to mix fuel and oxidizer and to diffuse the mixture in said combustion chamber, said mixer/deflector assembly comprising a first spinner device or "primary swirler" and at least one second spinner device or "secondary swirler" disposed coaxially at a determined distance from each other and separated by a Venturi device disposed coaxially with said injection nozzle, wherein said first spinner device is fixed securely to said injection nozzle and is spaced apart therefrom by a constant radial distance that is determined in such a manner that the fuel vaporized by said injection nozzle can under no circumstances impact on said first spinner device.

Preferably, said second spinner device is mounted to slide relative to said injection nozzle via a ring secured to said second spinner device and capable of moving perpendicularly to an axis of symmetry S of said injection nozzle in an annular housing of said Venturi device.

With this sliding connection system associated with the secondary swirler alone, any reverse flow injection of fuel in the primary swirler is eliminated.

In an advantageous embodiment, the Venturi device has an inside surface presenting a slope discontinuity on an upstream portion. This upstream portion of the inside surface of the Venturi device can include a step that is concave or that is convex.

With this specific architecture for the Venturi, fuel injection by capillarity into the primary swirler can be limited.

BRIEF DESCRIPTION OF THE DRAWINGS

The characteristics and advantages of the present invention appear better from the following description made by way of non-limiting indication and with reference to the accompanying drawings, in which.

DETAILED DESCRIPTION OF A PREFERRED EMBODIMENT

Figure 1:
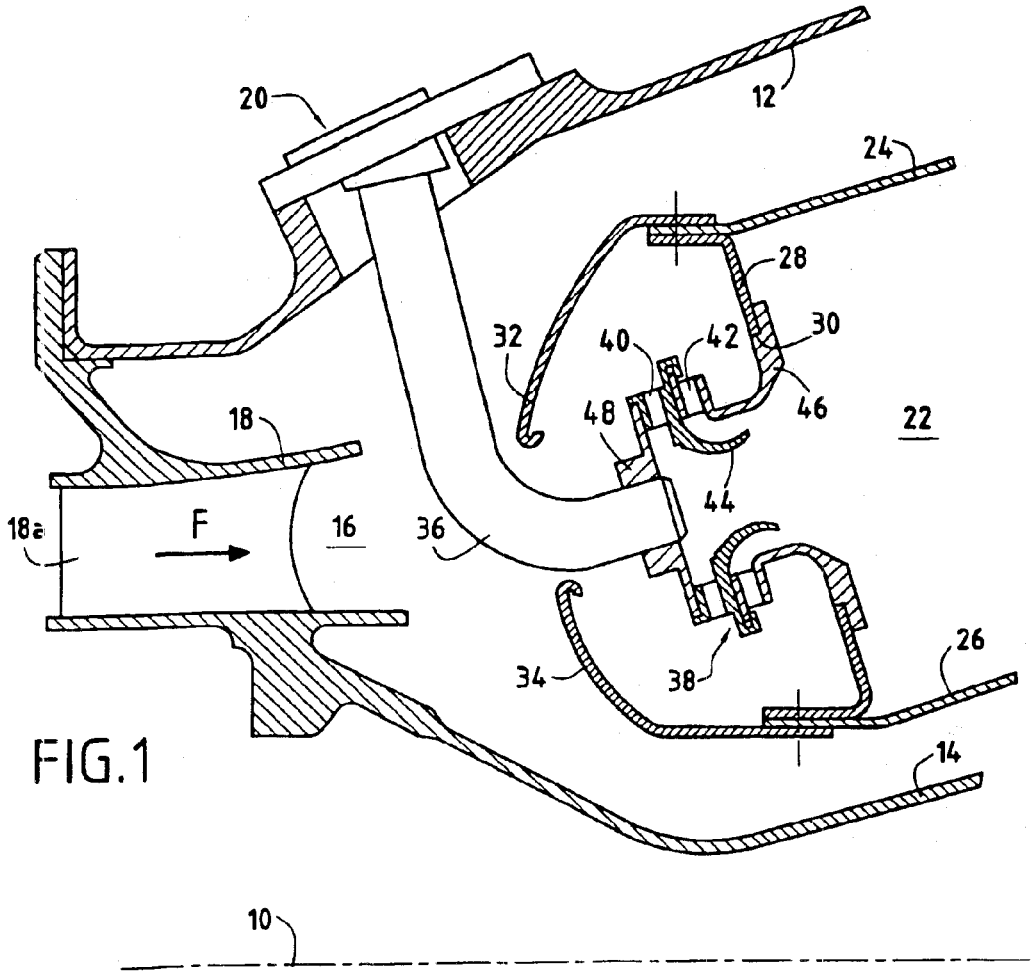
FIG. 1 is a diagrammatic axial half-section view of an injection portion of a turbomachine in accordance with the invention.

FIG. 1 is an axial half-section view of an injection portion of a turbomachine, comprising:

an outer annular shell (or outer case) 12 having a longitudinal axis 10;

an inner annular shell (or inner case) 14 coaxial therewith;

an annular space 16 extending between the two shells 12 and 14 and receiving compressed oxidizer, generally air, coming from an upstream compressor (not shown) of the turbomachine via an annular diffuser manifold 18 (the presence of a diffuser grid 18*a* should be observed) defining a general gas flow direction F, said space 16 containing, in the gas flow direction, firstly an injection assembly comprising a plurality of injection systems 20 fixed to the outer annular shell 12 and uniformly distributed around the manifold 18, and then an annular combustion chamber 22, and finally an annular nozzle (not shown) forming the inlet stage of a high pressure turbine.

The annular combustion chamber comprises an outer axially-extending side wall 24 and an inner axially-extending side wall 26, both coaxial about the axis 10, and a transverse end wall 28 provided with a plurality of openings 30 to which the injection systems are fixed. The various connections between the upstream ends of the axially-extending side walls of the chamber 24, 26, optionally of caps 32, 34 extending said ends of the side walls in an upstream direction, and the folded margins of the chamber end wall 28 are provided by any conventional connection means (not shown), for example flat-head bolts, preferably with captive type nuts.

Each injection system of the injection assembly comprises firstly a fuel injection nozzle 36 for vaporizing fuel in the combustion chamber, and secondly a mixer/deflector assembly 38 that is coaxial with the injection nozzle and that serves to mix the fuel and the oxidizer together and to diffuse the mixture in the combustion chamber. The mixer/deflector assembly comprises at least a first spinner device or primary swirler 40 and a second spinner device or secondary swirler 42 that are axially spaced apart from each other by a determined distance and that are separated by a Venturi device 44. The secondary swirler is extended by a deflector 46 fixed to the chamber end wall 28 and extending through the opening 30 into the combustion chamber 22.

According to the invention, the primary swirler 40 is secured to the injection nozzle 36, e.g. via a sleeve 48, and it is therefore separated therefrom by a radial distance that is constant. This distance is determined in such a manner that regardless of the operating speed of the turbomachine (windmilling, idling, full speed), the fuel vaporized by the injection nozzle can under no circumstances strike against the primary swirler. This ensures that no fuel is injected in the counterflow direction into said primary swirler as can result from fuel dispersions that exist naturally from one injection to another (because of injection angles, circumferential uniformity, etc.) such as fuel bouncing off the Venturi device.

Figure 2:
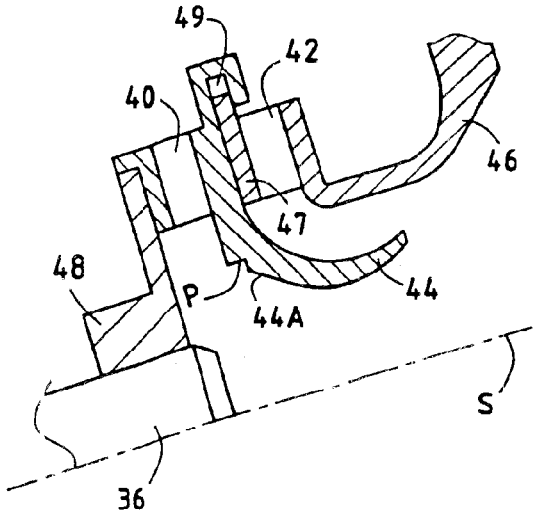
FIG. 2 is an enlarged view of a portion of FIG. 1 in a first embodiment of the invention.
Figure 3:
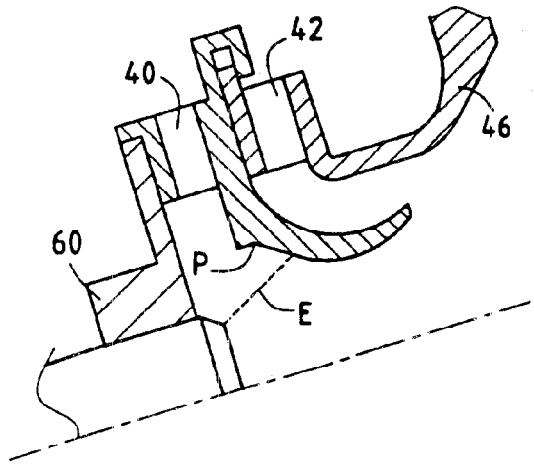
FIG. 3 is an enlarged view of a portion of FIG. 1 in a second embodiment of the invention.
Figure 4:
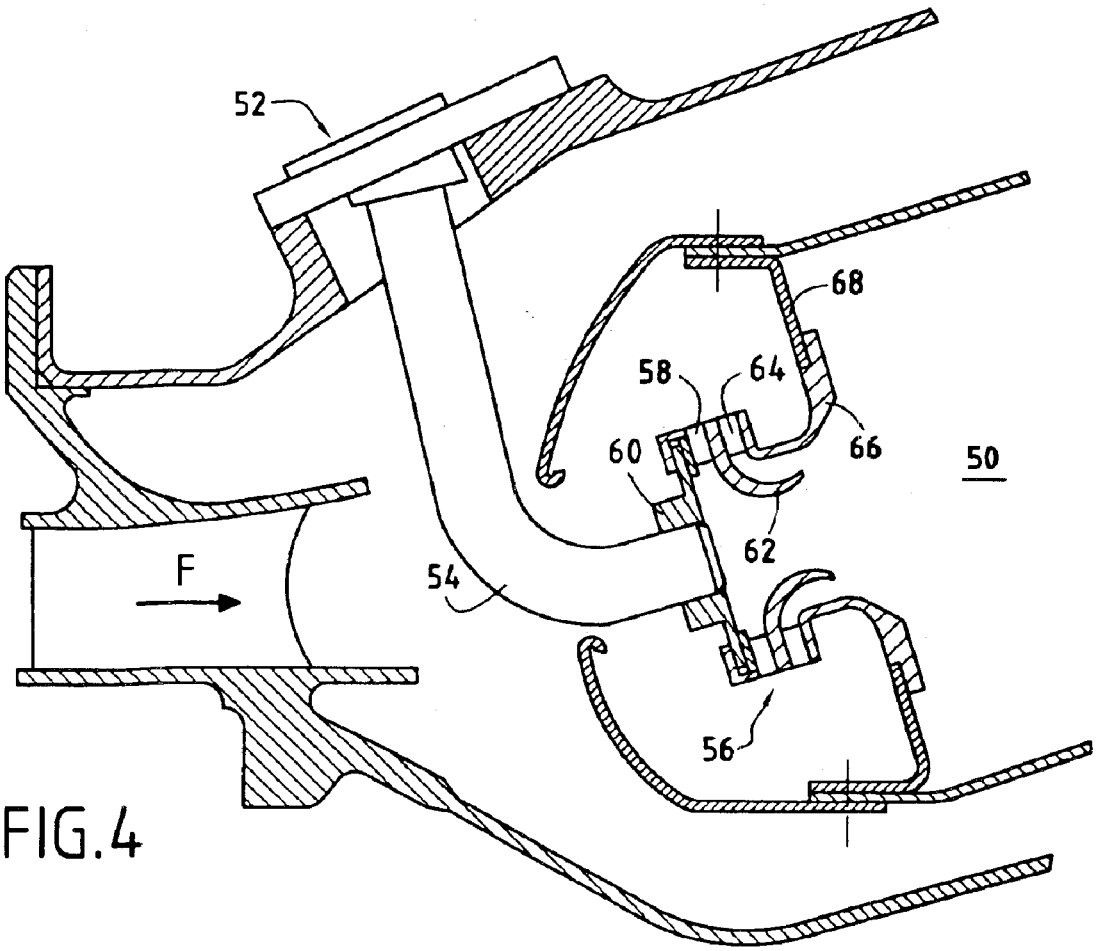
FIG. 4 is a diagrammatic axial half-section view of an injection portion of a turbomachine incorporating a prior art injection system.
Figure 5:
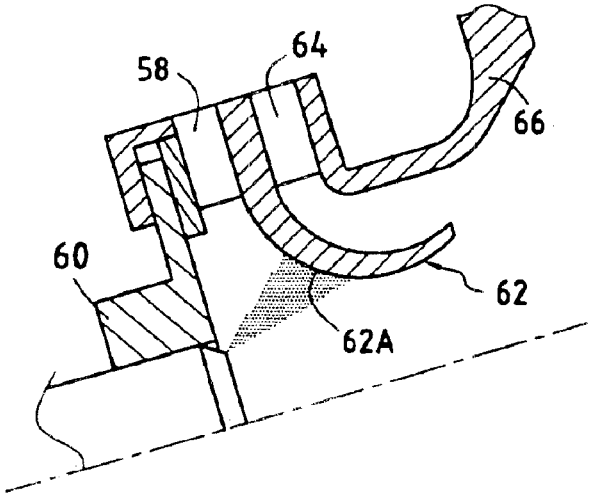
PRIOR ART FIG.5
FIG. 5 is an enlarged view of a portion of FIG. 4.

In a first embodiment of the invention as shown in FIG. 2, the Venturi device also has an upstream portion on its inside surface 44A that presents a slope discontinuity at P so as to prevent, or at least considerably reduce, any risk of fuel rising by capillarity into the primary swirler 40 of the injection system 20. This discontinuity in the slope provided upstream from the outer surface E (illustrated in FIG. 3) of the fuel injection cone can be constituted, for example, by a step that is concave. In the embodiment shown in FIG. 3, this slope discontinuity is constituted, in contrast, by a step that is convex.

In addition, in order to leave sufficient clearance between the injection nozzle 36 which is secured to the outer shell 12 and the mixer/deflector assembly 38 (in particular in order to accommodate thermal expansion), the secondary swirler 42 is mounted to slide relative to said injection nozzle perpendicularly to the axis of symmetry S of the nozzle, e.g. via a ring 47 fixed to said secondary swirler and capable of moving in an annular housing 49 of the Venturi device 44. For this purpose, sufficient clearance is left between the inner periphery of this annular housing and the outer periphery of the ring.

With the proposed configuration for the sliding connection, the injection nozzle is constantly centered relative to the primary swirler and the Venturi device, thus avoiding any injection of fuel in the counterflow direction, and the discontinuity in the slope of the Venturi also serves to prevent any fuel rising under capillarity. Thus, with the particular structure of the invention, it is guaranteed that the fuel will be sprayed properly under all flight conditions, and in particular under the most severe conditions of relighting while windmilling at low Mach numbers, conditions in which air feed head losses are too small to guarantee that the fuel is sufficiently fragmented, thus opening the way to a vast range in which relighting is possible.

What is claimed is:

1. An injection system for a turbomachine combustion chamber, the system comprising:

a fuel injection nozzle for vaporizing fuel in the combustion chamber; and a mixer/deflector assembly disposed coaxially with said injection nozzle and serving to mix fuel and oxidizer and to diffuse the mixture in said combustion chamber, said mixer/deflector assembly comprising a first spinner device, or primary swirler, and at least one second spinner device, or secondary swirler, disposed coaxially at a determined distance from the first spinner device and separated by a Venturi device disposed coaxially with said injection nozzle and fixed securely to said first spinner device, wherein said first spinner device is fixed securely to said injection nozzle and is spaced apart therefrom by a constant radial distance, and an upstream portion of an inside surface of the Venturi device has a slope discontinuity comprising a step that is concave.

2. The injection system according to claim 1, wherein said second spinner device is mounted to slide relative to said injection nozzle via a ring secured to said second spinner device and capable of moving perpendicularly to an axis of symmetry of said injection nozzle in an annular housing of said Venturi device.

3. An injection system for a turbomachine combustion chamber, the system comprising:

a fuel injection nozzle for vaporizing fuel in the combustion chamber; and a mixer/deflector assembly disposed coaxially with said injection nozzle and serving to mix fuel and oxidizer and to diffuse the mixture in said combustion chamber, said mixer/deflector assembly comprising a first spinner device, or primary swirler, and at least one second spinner device, or secondary swirler, disposed coaxially at a determined distance from the first spinner device and separated by a Venturi device disposed coaxially with said injection nozzle and fixed securely to said first spinner device, wherein said first spinner device is fixed securely to said injection nozzle and is spaced apart therefrom by a constant radial distance, and an upstream portion of an inside surface of the Venturi device has a slope discontinuity comprising a step that is convex.

4. The injection system according to claim 3, wherein said second spinner device is mounted to slide relative to said injection nozzle via a ring secured to said second spinner device and capable of moving perpendicularly to an axis of symmetry of said injection nozzle in an annular housing of said Venturi device.

* * * * *